US005379729A

United States Patent [19]

Yonezwa et al.

[11] Patent Number: 5,379,729

[45] Date of Patent: Jan. 10, 1995

[54] CYLINDER HEAD COOLING STRUCTURE FOR MULTI-VALVE ENGINE

[75] Inventors: Minoru Yonezwa; Junkichi Amano, both of Iwata, Japan

[73] Assignee: Yamaha Hatsudoki Kabushiki Kaisha, Iwata, Japan

[21] Appl. No.: 166,215

[22] Filed: Dec. 13, 1993

[30] Foreign Application Priority Data

Dec. 11, 1992 [JP] Japan ..... 4-352347

[51] Int. Cl.[6] ..... F02F 1/36

[52] U.S. Cl. ..... 123/41.82 R

[58] Field of Search ..... 123/41.82 R, 41.74, 123/432

[56] References Cited

U.S. PATENT DOCUMENTS

| | | | |
|---|---|---|---|
| 2,710,602 | 6/1955 | Maybach | 123/41.82 R |
| 5,081,960 | 1/1992 | Shimamoto | 123/41.82 R |
| 5,094,193 | 3/1992 | Yoshikawa | 1123/41.82 R |
| 5,222,464 | 6/1993 | Oyaizu | 123/41.82 R |

*Primary Examiner*—Noah P. Kamen

*Attorney, Agent, or Firm*—Knobbe, Martens, Olson & Bear

[57] ABSTRACT

An improved cylinder head cooling arrangement for use in multiple valve internal combustion engines wherein the coolant exits the cylinder head through primarily a single exit passage formed in the lower cylinder head surface beneath a manifold section of the cooling jacket that extends beneath the multiple exhaust passages.

21 Claims, 5 Drawing Sheets

CYLINDER HEAD COOLING STRUCTURE FOR MULTI-VALVE ENGINE

BACKGROUND OF THE INVENTION

This invention relates to a cylinder head cooling structure for a multi-valve engine and more particularly to an improved cooling arrangement for an overhead valve internal combustion engine having multiple valves.

As is well known, overhead valve internal combustion engines have a number of advantages from combustion and induction efficiency standpoints. However, the use of overhead valves greatly complicates the configuration and formation of the cylinder head. That is, it is necessary to form not only the intake and exhaust passages in the cylinder head as well as the combustion chamber and spark plug receiving recess or recesses but also to provide adequate cooling around at least the combustion chamber and the exhaust passages. In addition, it is desirable to provide cooling around the intake passage so as to improve volumetric efficiency.

It is also well known that the performance of the engine can be improved by using multiple and smaller size valves than single large diameter valves and passages. However, as multiple passages are employed, then the problems aforenoted become particularly acute.

These problems and those attendant with conventional cylinder head cooling arrangements may be best understood by reference to FIGS. 1 through 5. FIG. 1 is a partial cross-sectional view taken through a portion of a single cylinder of a conventional engine construction while FIG. 2 is a lower plan view of the cylinder head and FIG. 3 is a cross-sectional view taken along the line 3—3 of FIG. 2 and also along substantially the same plane as that of FIG. 1. FIG. 4 is a further enlarged view of a portion of the cylinder head as shown in FIG. 3 and FIG. 5 is a cross-sectional view taken along the line 5—5 of FIG. 4.

Referring first to FIG. 1, an engine is identified generally by the reference numeral 11 and is illustrated partially and in cross section taken through a single of the cylinders. It is believed that those skilled in the art will understand well how the prior art construction is employed to various types of multiple cylinder engines and, in the same sense, how the invention can be practiced with multiple cylinder engines of any configuration. FIG. 1 may be considered to be a typical view for both the prior art construction and the embodiment of the invention which will be specifically described later.

The engine 11 includes a cylinder block 12 which defines a cylinder bore 13 in which a piston 14 is supported for reciprocation. The piston 14 is connected by means of a connecting rod 15 to a crankshaft in a well known manner. A cylinder head assembly, indicated generally by the reference numeral 16 is affixed to the cylinder block 12 in a well known manner including by means of head bolts 17 which appear in certain of the figures. This cylinder head assembly 16 has a lower surface 18 that engages a cylinder head gasket 19 and closes the cylinder bore 13. A combustion chamber recess 21 is formed in alignment with the cylinder bore 13 and is surrounded by the gasket 19 and lower surface 18 for compression sealing.

A pair of intake passages 22 are formed in the cylinder head assembly 16 on one side thereof and extend from a sealing surface 23 on the outer periphery of the cylinder head 16 and is adapted to be engaged by a suitable induction system including an intake manifold and charge formers (not shown). These intake passages 22 terminate in valve seats formed in the cylinder head recess 21 and intake valves 24 are slidably supported in the cylinder head assembly 16 for controlling the communication of the intake passages 22 with the combustion chamber. These intake valves 24 are operated in a known manner as by an overhead cam assembly 25 which may have any conventional type of construction.

A pair of siamesed exhaust passages 26 extend through the opposite side of the cylinder head and terminate in a surface 27 of the cylinder head 16 to which an exhaust manifold (not shown) is affixed. These exhaust passages 26 extend from exhaust valve seats which are opened and closed by exhaust valve 28 slidably supported in the exhaust side of the cylinder head 16 in a well known manner.

The cylinder block 12 is provided with a cooling jacket 31 through which coolant is circulated in a manner well known in the art. In addition, the cylinder head 16 is provided with a cooling jacket, indicated generally by the reference numeral 32. This cooling jacket 32 extends in proximity to the combustion chamber recess 21 and around at least in part the intake passages 22 and the exhaust passages 26 for providing cooling. In the illustrated construction, coolant is delivered to the cylinder head cooling jacket 32 on the intake side of the engine from the cylinder block cooling jacket 31 through delivery ports 33 which extend through the lower face of the cylinder head surface 18 and which communicate with corresponding openings formed in the upper surface of the cylinder block 12. This coolant then flows across the cylinder head to the exhaust side and cools the exhaust passages 26. This coolant is then discharged down back into the cylinder block cooling jacket 31 through a pair of large discharge ports 34 which are positioned beneath the exhaust passages 26.

The cooling jacket 32 of the cylinder head 16 is formed by a sand core, as is well known in this art. The openings 34 and 33 are provided for the primary purpose of permitting the sand to be removed from the cylinder head casting 16 at the completion of the casting process. However, these openings also serve the purpose of providing water flow passages, as aforenoted.

There is further provided a flow passage 35 (FIGS. 3 and 5) which extends in part through a dividing wall 36 that separates the non-siamese portion of the exhaust passages 36 from each other. This passage 35 communicates with a further discharge port 37 formed in the lower cylinder head surface 18. Coolant flows to the passage 35 from the area around spark plugwalls 38 through passages 39.

As a result of this construction, the water flow through the cylinder head cooling jacket 32 is as shown by the arrows in FIGS. 3 and 5. However, it should be noted that the passageway 35 and discharge port 37 are relatively small and a stagnant water area will be formed around the area between the exhaust passages 26. This can give rise to hot spots which will interfere with the effective cooling of the engine.

It is, therefore, a principal object of this invention to provide an improved engine cooling arrangement for the cylinder head of a multiple valve internal combustion engine.

It is a further object of this invention to provide an improved cylinder head cooling system for an engine having multiple intake and/or exhaust passages wherein it will be ensured that there are no stagnant areas in the flow path and that adequate cooling of all parts of the cylinder head will be provided.

SUMMARY OF THE INVENTION

This invention is adapted to be embodied in a cylinder head cooling arrangement for an overhead valve internal combustion engine comprising a cylinder head having a lower surface adapted to be sealingly engaged with a cylinder block around a cylinder bore. The cylinder head lower surface has a portion cooperating with the cylinder bore to form a combustion chamber. At least one valve seat is formed on one side of the cylinder head lower surface at one end of a first gas flow passage formed in the one side of the cylinder head. At least a pair of valve seats are formed on the other side of the cylinder head lower surface portion at one end of respective second and third flow passages formed in the other side of the cylinder head. A water jacket is formed in the cylinder head at least in part around the flow passages and the cylinder head lower surface portion. A cooling flow passage is formed in the cylinder head lower surface and in an area between and beneath the second and third flow passages which communicates with a manifold section of the cooling jacket that extends between the lower surface and the second and third flow passages. The cooling flow passages passes substantially all of the coolant flowing through the manifold section between the areas beneath the second and third flow passages.

DETAILED DESCRIPTION OF THE PREFERRED EMBODIMENT OF THE INVENTION

Figure 1:
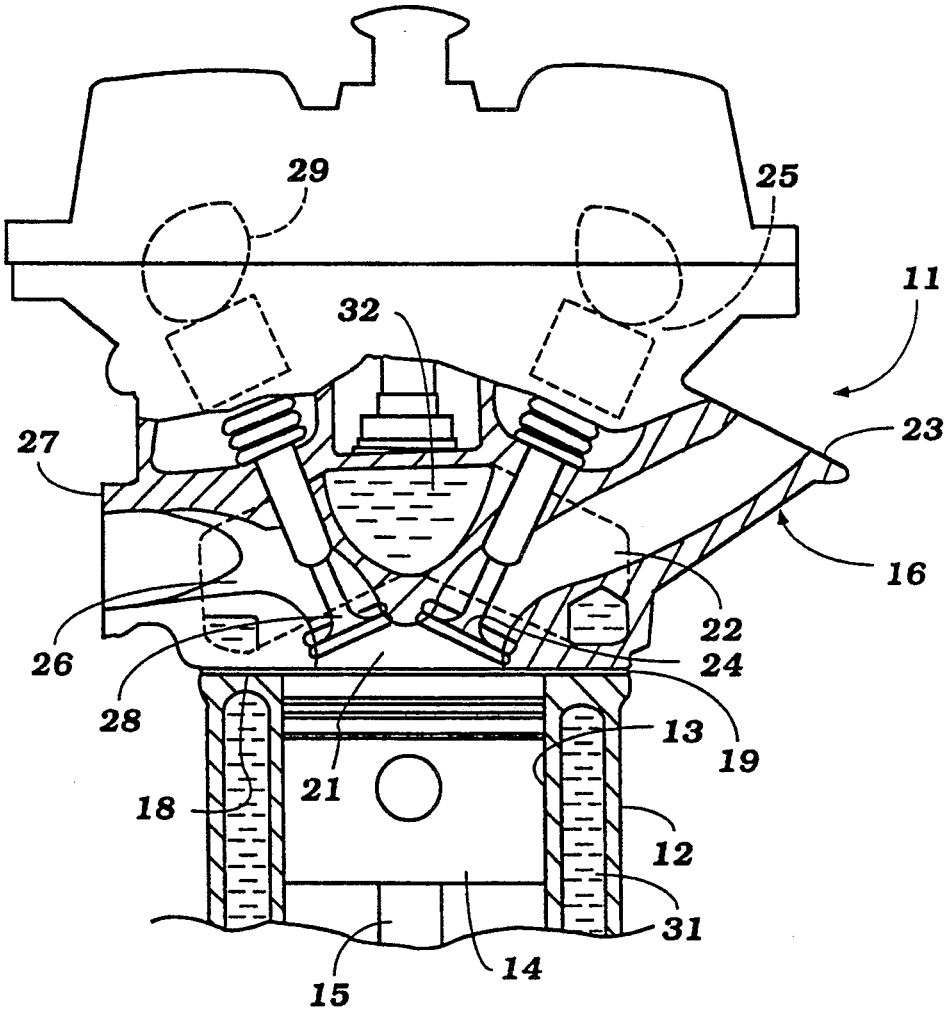
FIG. 1 is a cross-sectional view taken through a single cylinder of a multiple cylinder in-line engine constructed in accordance with either the prior art or the embodiment of the invention which is specifically disclosed.
Figure 2:
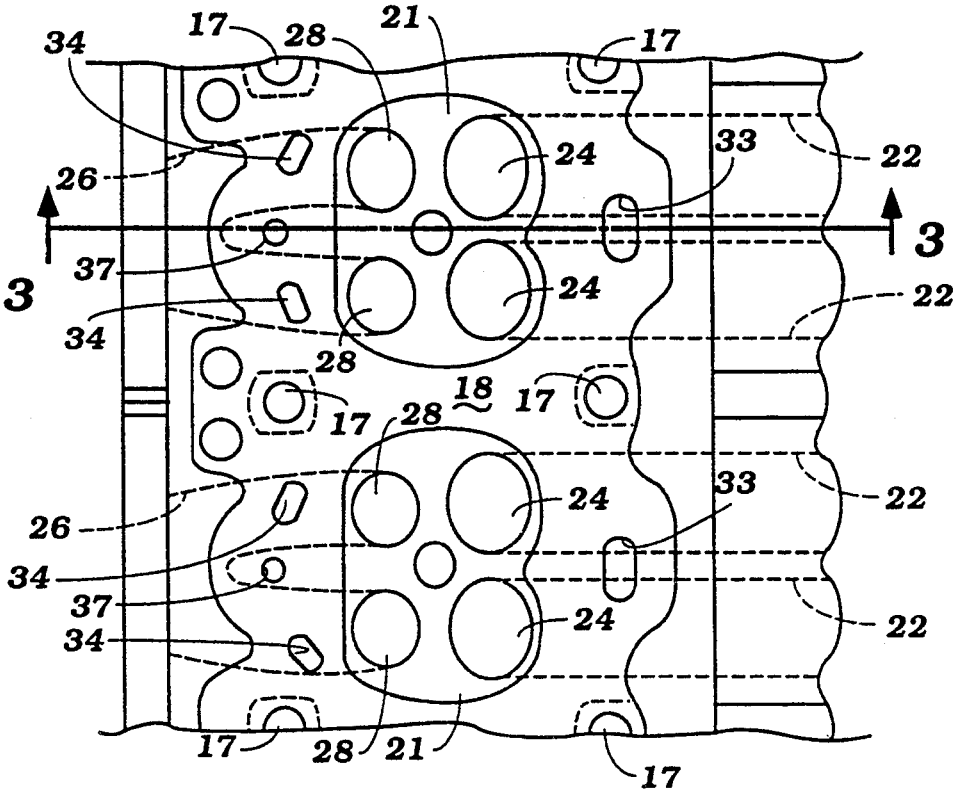
Figure 2 Prior Art
FIG. 2 is a bottom plan view of a portion of a cylinder head assembly constructed in accordance with a prior art type of construction.
Figure 3:
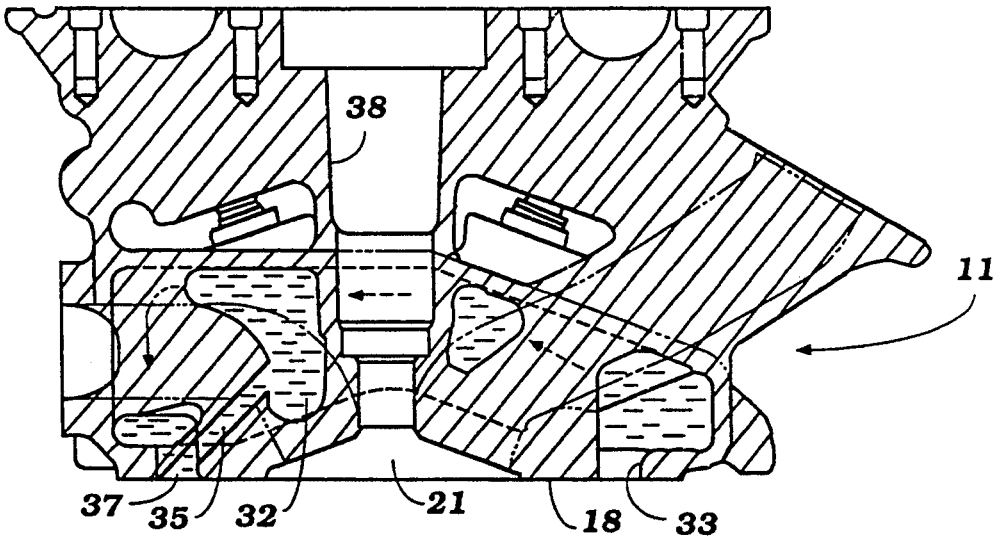
Figure 3 Prior Art
FIG. 3 is a cross-sectional view taken along the line 3—3 of FIG. 2 showing further details of the prior art type of construction.
Figure 4:
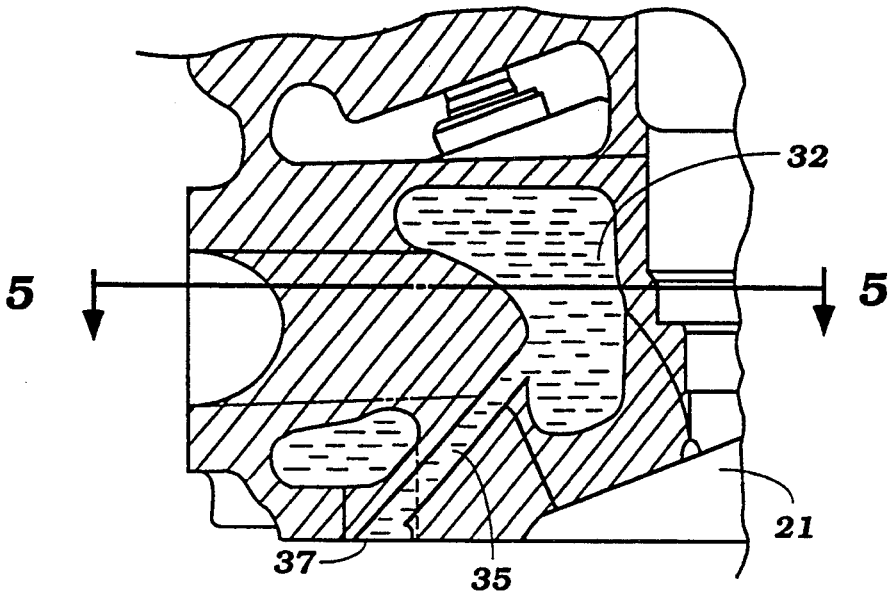
Figure 4 Prior Art
FIG. 4 is an enlarged cross-sectional view of the area shown to the left hand or exhaust side of FIG. 3.
Figure 5:
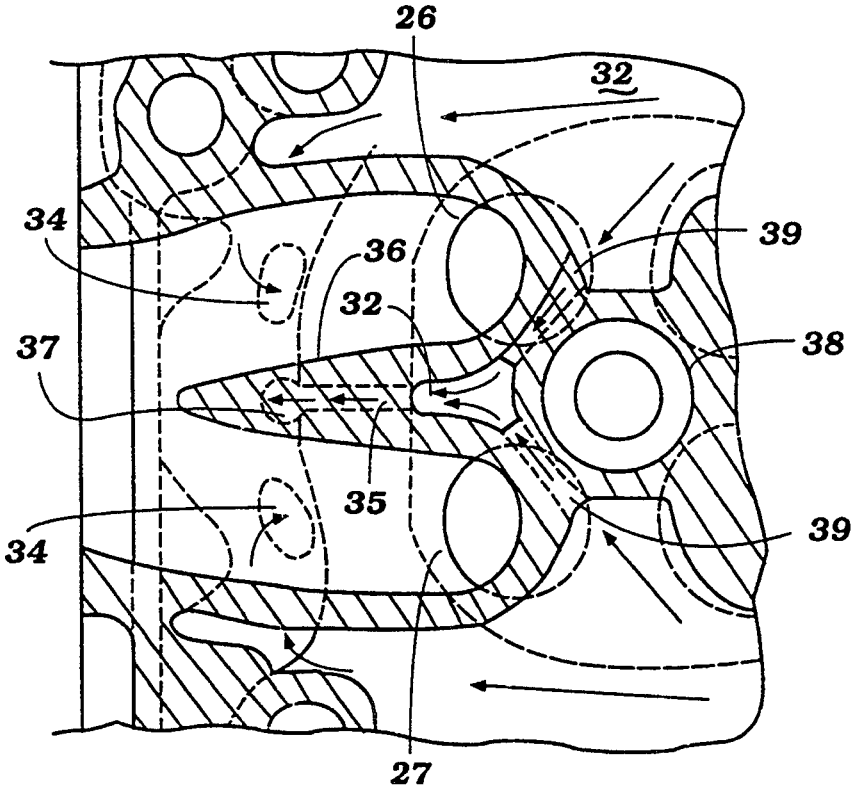
Figure 5 Prior Art
FIG. 5 is a cross-sectional view taken along the line 5—5 of FIG. 4.
Figure 6:
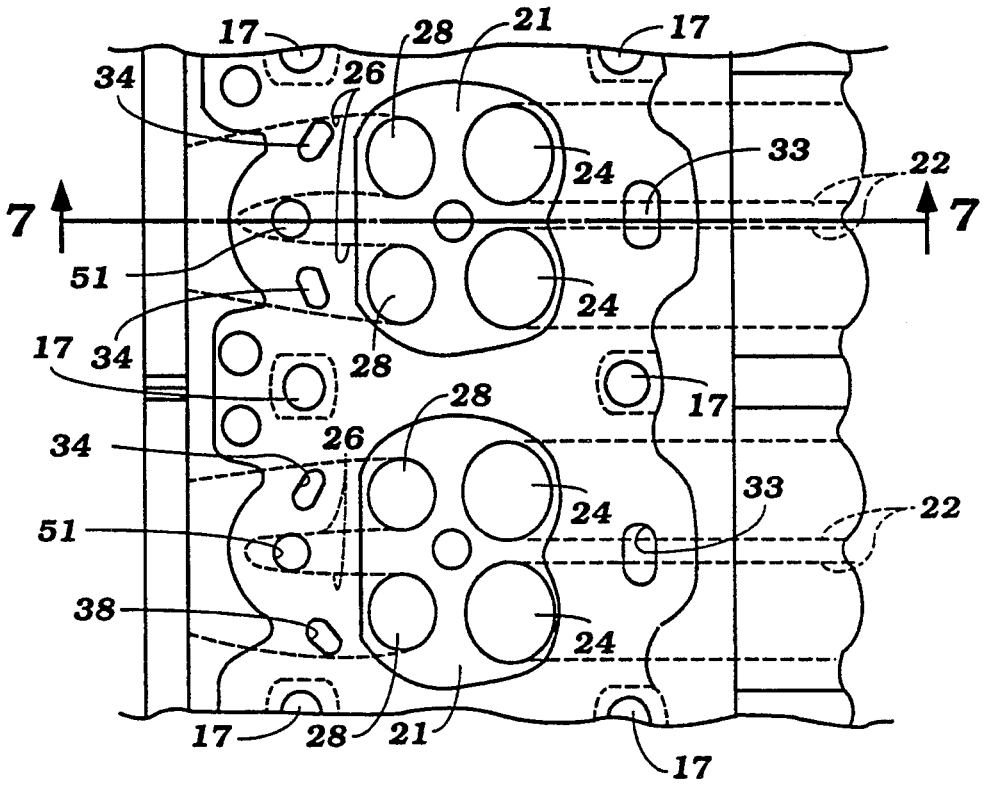
FIG. 6 is a bottom plan view of a cylinder head assembly, in part similar to FIG. 2, but showing an embodiment of the invention.

Because the components of the invention are embodied in a construction which has general similarity to the prior art type of construction thus far described, where those components are the same or substantially the same they have been indicated by the same reference numerals and will be described again only insofar as is necessary to understand the construction and operation of this embodiment. Basically, the configuration of the cylinder head 16, intake passages 22 and exhaust passages 26 as well as the shape of the combustion chamber 21 are the same as that previously described.

In accordance with the invention, the water return passages that extend between the exhaust port 26 from the area between them are formed as substantially larger openings 51 which extend through the lower cylinder head surface 18. The cylinder head gasket 19, which does not appear in these figures, is made so as to obscure a substantial portion or preferably all of the openings 34 and thus substantially all of the water flow exiting the cylinder head must pass through the discharge opening 51. In addition, the discharge opening area of the total flow is approximately one-half of the inlet flow area so that velocity exiting the cylinder head will be substantially greater than that entering the cylinder head. This further ensures against any stagnant water being contained in the cylinder head and will ensure that there is adequate cooling of the cylinder head 16 and the ports therein.

Figure 7:
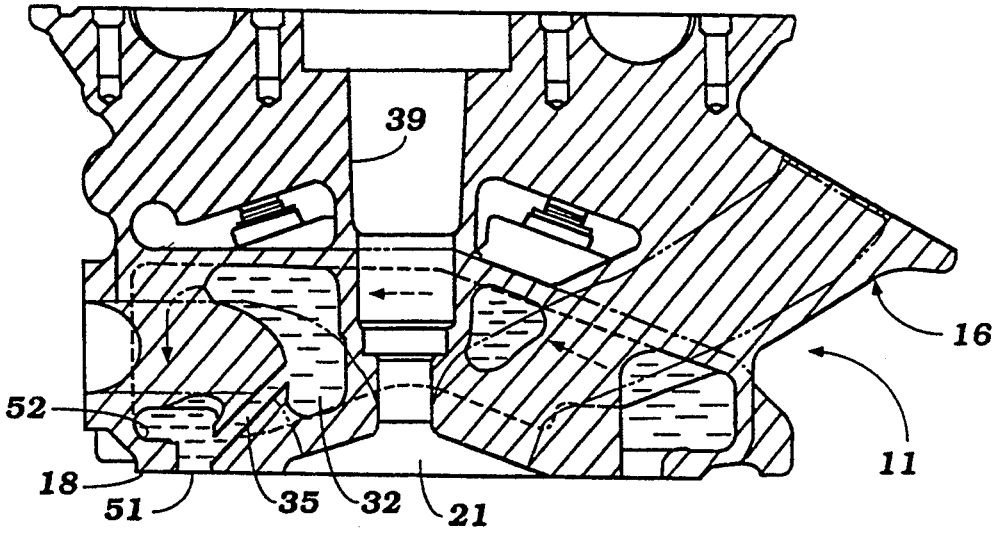
FIG. 7 is a cross-sectional view taken along the 7—7 of FIG. 6.
Figure 8:
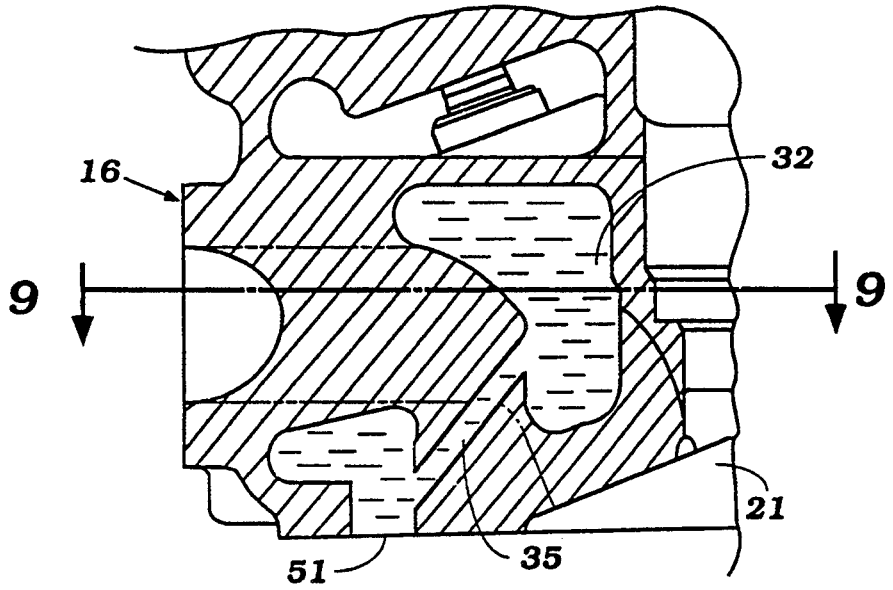
FIG. 8 is a further enlarged cross-sectional view of the exhaust or left hand side area of FIG. 7.
Figure 9:
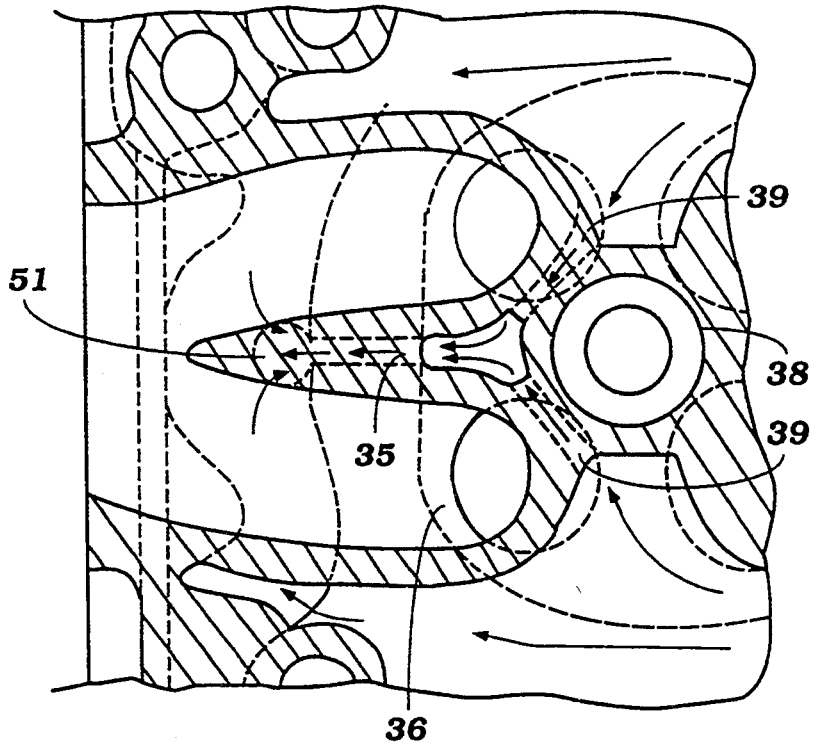
FIG. 9 is a further enlarged cross-sectional view taken along the line 9—9 of FIG. 8.

The flow of coolant in the embodiment is indicated by the arrows in FIGS. 7 and 9 and it will be seen that all of the water flows through a manifold portion 52 of the cylinder head 16 which passes under the exhaust passages 26. In this way, there will be absolute insurance of adequate cooling.

It should be readily apparent from the foregoing description that the described embodiment of the invention is extremely effective in insuring good and adequate cooling of a cylinder head having multiple overhead valves. Of course, the foregoing description is that of a preferred embodiment of the invention and various changes and modifications may be made without departing from the spirit and scope of the invention, as defined by the appended claims.

We claim:

1. A cylinder head cooling arrangement for an overhead valve internal combustion engine comprising a cylinder head having a lower surface adapted to be sealingly engaged with a cylinder block around a cylinder bore, said cylinder head lower surface having a portion cooperating with said cylinder bore to form a combustion chamber, at least one valve seat on one side of said cylinder head lower surface portion at one end of a first gas flow passage formed in one side of said cylinder head, at least a pair of valve seats formed on the other side of said cylinder head lower surface portion at the end of respective second and third flow passages formed in the other side of said cylinder head and separated at least in part by a wall, a coolant jacket formed in said cylinder head at least in part around said flow passages and said cylinder head lower surface portion, and a coolant flow passage formed in said cylinder head lower surface and in an area beneath said wall and between said second and third flow passages, and a manifold section extending between said lower surface and the area below said second and third flow passages and communicating with said coolant passage, said coolant flow passage passing substantially all of the coolant flowing through said manifold section in the area beneath said second and third flow passages.

2. The cylinder head cooling arrangement for an overhead valve internal combustion engine as defined in claim 1, further including a further coolant flow passage extending through said wall from said cooling jacket to said manifold section.

3. The cylinder head cooling arrangement for an overhead valve internal combustion engine as defined in claim 2, wherein the further flow passage in the wall terminates at the coolant flow passage formed in the cylinder head lower surface.

4. The cylinder head cooling arrangement for an overhead valve internal combustion engine as defined in claim 1, wherein the cooling flow passage forms the exit for coolant from the cylinder head cooling jacket and wherein coolant is introduced to the cylinder head through the one side of the cylinder head.

5. The cylinder head cooling arrangement for an overhead valve internal combustion engine as defined in claim 4, further including at least a fourth valve seat on the one side of the cylinder head lower surface portion at one end of a fourth gas flow passage formed in the one side of the cylinder head.

6. The cylinder head cooling arrangement for an overhead valve internal combustion engine as defined in claim 5, further including a coolant inlet flow passage formed in the lower surface of the one side of the cylinder head for receiving coolant from the cylinder block.

7. The cylinder head cooling arrangement for an overhead valve internal combustion engine as defined in claim 6, further including a further flow passage extending through said wall from said cooling jacket to said manifold section.

8. The cylinder head cooling arrangement for an overhead valve internal combustion engine as defined in claim 7, wherein the further flow passage in the wall terminates at the coolant flow passage formed in the cylinder head lower surface.

9. The cylinder head cooling arrangement for an overhead valve internal combustion engine as defined in claim 6, further including a pair of further coolant flow passages formed in the cylinder head lower surface and intersecting the manifold section.

10. The cylinder head cooling arrangement for an overhead valve internal combustion engine as defined in claim 9 including means for restricting coolant flow through said pair of further coolant flow passages.

11. The cylinder head cooling arrangement for an overhead valve internal combustion engine as defined in claim 10, wherein the pair of further coolant flow passages are substantially restricted by a cylinder head gasket interposed between the cylinder head and the cylinder block.

12. The cylinder head cooling arrangement for an overhead valve internal combustion engine as defined in claim 11, wherein the cylinder head gasket closes the pair of further coolant flow passages.

13. The cylinder head cooling arrangement for an overhead valve internal combustion engine as defined in claim 12, further including a further coolant flow passage extending through said wall from said cooling jacket to said manifold section.

14. The cylinder head cooling arrangement for an overhead valve internal combustion engine as defined in claim 13, wherein the further coolant flow passage in the wall terminates at the coolant flow passage formed in the cylinder head lower surface.

15. The cylinder head cooling arrangement for an overhead valve internal combustion engine comprising a cylinder head having a lower surface adapted to be sealingly engaged with a cylinder block around a cylinder bore, said cylinder head lower surface having a portion cooperating with said cylinder bore to form a combustion chamber, at least one valve seat on one side of said cylinder head lower surface portion at one end of a first gas flow passage formed in one side of said cylinder head, at least a pair of valve seats formed on the other side of said cylinder head lower surface portion at the end of respective second and third flow passages formed in the other side of said cylinder head, a coolant jacket formed in said cylinder head at least in part around said flow passages and said cylinder head lower surface portion, a first coolant flow passage formed in said cylinder head lower surface and in an area beneath and between said second and third flow passages communicating with a manifold section that extends between said lower surface and said second and third flow passages, said first coolant flow passage passing substantially all of the coolant flowing through said manifold section in the area beneath said second and third flow passages, and a pair of further coolant flow passages formed in said cylinder head lower surface and intersecting said manifold section.

16. The cylinder head cooling arrangement for an overhead valve internal combustion engine as defined in claim 15 including means for restricting coolant flow through the further coolant flow passages.

17. The cylinder head cooling arrangement for an overhead valve internal combustion engine as defined in claim 16, wherein the further coolant flow passages are substantially restricted by a cylinder head gasket interposed between the cylinder head and the cylinder block.

18. The cylinder head cooling arrangement for an overhead valve internal combustion engine as defined in claim 17, wherein the cylinder head gasket completely closes the further coolant flow passages.

19. The cylinder head cooling arrangement for an overhead valve internal combustion engine as defined in claim 17, wherein a wall is formed between at least a portion of the second and third flow passages.

20. The cylinder head cooling arrangement for an overhead valve internal combustion engine as defined in claim 19, further including a a fourth coolant flow passage extending through said wall from said cooling jacket to said manifold section.

21. The cylinder head cooling arrangement for an overhead valve internal combustion engine as defined in claim 20, wherein the fourth coolant flow passage in the wall terminates at the coolant flow passage formed in the cylinder head lower surface.

* * * * *